United States Patent [19]

Wehle et al.

[11] 4,105,405

[45] Aug. 8, 1978

[54] METHOD AND COMPOSITION FOR INHIBITING CORROSION OF METALS IN CONTACT WITH WATER

[75] Inventors: Volker Wehle, Hilden; Jürgen Reiffert, Oberhausen, both of Fed. Rep. of Germany

[73] Assignee: Henkel Kommanditgesellschaft auf Aktien, Dusseldorf-Holthausen, Fed. Rep. of Germany

[21] Appl. No.: 854,029

[22] Filed: Nov. 22, 1977

[30] Foreign Application Priority Data

Nov. 27, 1976 [DE] Fed. Rep. of Germany ..... 2653933

[51] Int. Cl.[2] ..... C23F 11/12; C23F 11/18; C23F 11/16

[52] U.S. Cl. ..... 21/2.7 R; 252/389 R; 252/396

[58] Field of Search ..... 21/2.7 R; 252/389 R, 252/396

[56] References Cited

U.S. PATENT DOCUMENTS

| | | | |
|---|---|---|---|
| 2,843,466 | 7/1958 | Greenwald | 252/396 X |
| 2,878,191 | 3/1959 | Montgomery | 21/2.7 R |
| 2,878,296 | 3/1959 | Montgomery | 252/396 X |
| 3,553,101 | 1/1971 | Foroulis | 21/2.7 R X |
| 3,578,589 | 5/1971 | Hwa et al. | 21/2.7 R X |
| 3,663,448 | 5/1972 | Ralston | 21/2.7 R X |
| 3,885,914 | 5/1975 | Hollingshad et al. | 21/2.7 R |
| 3,897,209 | 7/1975 | Harris et al. | 21/2.7 R |
| 3,931,029 | 1/1976 | Dutton et al. | 252/396 X |
| 3,974,083 | 8/1976 | Suen et al. | 21/2.7 R X |
| 3,981,682 | 9/1976 | Ward et al. | 21/2.7 R |

OTHER PUBLICATIONS

Chemical Abstracts, vol. 71, 1969, p. 101409m; "1,2,3,4,5,6-Cyclohexane-Hexacarboxylic Acid."

*Primary Examiner*—Barry S. Richman
*Attorney, Agent, or Firm*—Hammond & Littell

[57] ABSTRACT

A method for inhibiting corrosion of non-noble metals in contact with circulating water comprising the steps of adding to circulating water in contact with non-noble metals from 0.5 to 50 gm/m$^3$ of at least one cyclohexanehexacarboxylic acid and adjusting said water to a pH of from 6 to 9; as well as corrosion inhibitory compositions containing cyclohexanehexacarboxylic acid.

14 Claims, No Drawings

METHOD AND COMPOSITION FOR INHIBITING CORROSION OF METALS IN CONTACT WITH WATER

BACKGROUND OF THE INVENTION

The treatment of water in water-conveying plants, such as steam generating plants, heating systems, cooling water circulatory systems and water supply systems, for protection against the corrosive action of water which is principally directed against non-noble materials, for example, steel, brass, aluminum, zinc or galvanized steel, has long found technical application. In this respect the use of compounds that contain phosphorus, as, for example, phosphonic acids or inorganic phosphates, where necessary in combination with zinc salts, has proved particularly effective.

Such combinations are technically quite effective. One such effective combination is described in U.S. Pat. No. 3,723,333 and its reissue U.S. Pat. No. Re. 28,553. This combination is that of a diphosphonic acid, an N-methylenephosphonic acid and certain orthophosphates or zinc salts or silicates or nitrates.

The use of such combinations, however, in recent times is becoming more and more restricted by ecological and legislative demands for these products to be largely or completely free of compounds containing phosphorus. From the technical viewpoint, combinations of this kind containing phosphorus have the further disadvantage that they frequently lead to eutrophication of the cooling system due to intensified biological growth and therefore require the additional use of microbicides.

The use of such combinations containing phosphorus can further lead, when applied to water of great hardness, to the formation of apatite sediments or sediments similar to apatite, that lead to operating troubles and can only be removed with difficulty. The application of the said combinations at higher pH values (pH > 8.0) generally leads to a clogging of the system by the precipitation of zinc hydroxide.

OBJECTS OF THE INVENTION

An object of the present invention is to develop compositions and methods which inhibit corrosion in water-conveying systems without the use of substantial amounts of phosphorus-containing compounds.

Another object of the present invention is the development of a method for inhibiting corrosion of non-noble metals in contact with circulating water comprising the steps of adding to circulating water in contact with non-noble metals from 0.5 to 50 gm/m$^3$ of at least one cyclohexanehexacarboxylic acid and adjusting said water to a pH of from 6 to 9.

A further object of the present invention is the development of a corrosion inhibitory composition for use in water-conveying systems in contact with non-noble metals consisting essentially of from 10% to 90% by weight of cyclohexanehexacarboxylic acid, from 10% to 50% by weight of a water-soluble zinc salt, from 0 to 25% of a concretion prevention and dispersion agent, from 0 to 5% by weight of benzimidazole and from 0 to 2% by weight of a biocidal agent.

These and other objects of the invention will become more apparent as the description thereof proceeds.

DESCRIPTION OF THE INVENTION

According to the present invention there is provided a method for reducing or substantially preventing corrosion of metals in water systems, which comprises adding to the water of the system at least one cyclohexanehexacarboxylic acid, said water having a pH of 6 to 9.

More particularly, the present invention relates to a method for inhibiting corrosion of non-noble metals in contact with circulating water comprising the steps of adding to circulating water in contact with non-noble metals from 0.5 to 50 gm/m$^3$ of at least one cyclohexanehexacarboxylic acid and adjusting said water to a pH of from 6 to 9; as well as a corrosion inhibitory composition for use in water-conveying systems in contact with non-noble metals consisting essentially of from 10% to 90% by weight of cyclohexanehexacarboxylic acid, from 10% to 50% by weight of a water-soluble zinc salt, from 0 to 25% of a concretion prevention and dispersion agent, from 0 to 5% by weight of benzimidazole and from 0 to 2% by weight of a biocidal agent.

The quantities of cyclohexanehexacarboxylic acid that are administered to the water system for this purpose lie in the range from 0.5 to 50 gm/m$^5$, preferably 1 to 20 gm/m$^3$. The cyclohexanehexacarboxylic acids used are the commercial isomeric mixtures or also the individual cis-trans-isomers.

The production of cyclohexanehexacarboxylic acids and their isomeric forms is carried out in accordance with methods which in themselves are known, such as the hydrogenation of mellitic acid with sodium amalgam or the oxidation of bicyclo(2,2,2) oct-7-ene-2,3,5,6, tetracarboxylic acids with nitric acid in the presence of oxidation catalysts. Certain isomeric forms of the cyclohexanehexacarboxylic acids can also be obtained by dehydration at between 80° and 300° C and the subsequent hydrolysis of the dianhydride obtained.

The extraordinarily good corrosion-inhibiting effect of cyclohexanehexacarboxylic acids is surprising in that other compounds of similar structure, for example, mellitic acid or cyclopentanetetracarboxylic acids do not show, for practical purposes, sufficient effectiveness in protecting against corrosion.

With regard to the degree of desired protection against corrosion, the effectiveness can be considerably improved by the use of cyclohexanehexacarboxylic acids in combination with zinc salts such as zinc chloride or zinc sulfate. The zinc salts (expressed as zinc) are thereby used in quantities from 0.5 to 10gm/m$^3$, preferably 1 to 4 gm/m$^3$, corresponding to a quantity of 0.5 to 10 or 1 to 4 ppm, respectively.

In practice, the presence or formation of turbid matters which form sediments, examples of such matters being the hard precipitates, clay substances and iron hydroxides, plays an important role to a considerable extent with regard to the corrosive behavior of process water. By preventing such sedimentation, the corrosive behavior of the water is further improved. Thus, it is generally advantageous to add to the cyclohexanehexacarboxylic acid concretion preventing and dispersion means, in themselves known. Suitable additions have proved to be, in particular, polyacrylic acid or acrylic acid-methacrylic acid copolymerizates with an average molecular weight of between 500 and 4000, in the form of their alkali metal salts, or ethylene oxide/propylene oxide block polymers with an average molecular weight of between 500 and 3000 and an ethylene oxide:-propylene oxide ratio of from 10:90 to 30:70.

The aforementioned concretion preventing and dispersion means are used in combination with the cyclohexanehexacarboxylic acids in quantities of 1 to 50 gm/m$^3$, preferably 3 to 10 gm/m$^3$.

Depending on the ratios employed in practice, it can be advantageous to use, together with the cyclohexanehexacarboxylic acids, special inhibitors for non-ferrous metals such as, in particular, benzimidazole.

Lastly, biocidal substances such as glutaraldehyde, glyoxal, sodium pentachlorophenolate or alkyl-oligoamides, preferably the reaction products from dodecyl propylenediamine with E-caprolactam in the ratio 1:2, can also be used.

Composition for industrial use in water-conveying systems are preferably a combination of the cyclohexanehexacarboxylic acid and the water-soluble zinc salts, alone or in combination with the other above-recited ingredients. More particularly, the invention relates also to a corrosion inhibitory composition for use in water-conveying systems in contact with non-noble metals consisting essentially of from 10% to 90% by weight of cyclohexanehexacarboxylic acid, from 10% to 50% by weight of a water-soluble zinc salt, from 0 to 25% of a concretion prevention and dispersion agent, from 0 to 5% by weight of benzimidazole and from 0 to 2% by weight of a biocidal agent.

The present invention will now be further illustrated by way of the following examples and comparative experiments, without, however, it being limited thereto.

EXAMPLE 1 (Corrosive Protection)

The determination of corrosive behavior was carried out in accordance with the method described below:

Each carefully cleaned plate of test metal (75 × 12 × 1.5 mm) was immersed at room temperature for 24 hours in a one-liter beaker that was filled with one liter of water from the Düsseldorf city supply and a given quantity of the substances under investigation and stirred at 100 revolutions per minute. During the course of the experiment the aqueous solutions in a series of 10 beakers in toto were averaged to give the rate of corrosion protection. The metal plates were cleaned of corrosion products and the weight losses determined. The rate of corrosion protection of the protection of the products was obtained, in relation to the numerical value of a blank test, from the mean values of each three experiments.

Water from the Düsseldorf supply used as a corrosive medium had the following analytical data:

Total hardness: 16.5° dH
Carbonate hardness: 8.4° dH
$Cl^-$ conc.: 165 mg/l
pH range: 7.4 to 8.2

The following Table gives the reduction in the corrosive action of a sample of water on addition of the individually listed means in comparison to an untreated sample of water which is used as a value for 100% corrosion.

TABLE

| Product | Dosage (ppm) Acid | Dosage (ppm) $Zn^{++}$ | Reduction in Corrosion % |
|---|---|---|---|
| Numerical result of blank test | 0 | 0 | 0 |
| Cyclohexanehexacarboxylic acid (CHA) (Isomeric mixture) | 10 | 0 | 72 |
| Cyclopentanetetracarboxylic acid | 10 | 0 | 27 |

TABLE-continued

| Product | Dosage (ppm) Acid | Dosage (ppm) $Zn^{++}$ | Reduction in Corrosion % |
|---|---|---|---|
| Mellitic acid | 10 | 0 | 23 |
| Cyclohexanenexacarboxylic acid plus $Zn^{++}$ | 3 | 3 | 45 |
| | 5 | 3 | 79 |
| | 10 | 3 | 85 |

A commercial product with a base of aminotrimethylenephosphonic acid and a zinc salt employed at a dosage level of 10 ppm of aminotrimethylenephosphonic acid and 3 ppm of zinc salt expressed as $Zn^{++}$ gave a reduction in corrosion of 48%.

EXAMPLE 2

A technical cooling system with a capacity of 1.2m$^3$ and a circulation of 8 m$^3$/hr was operated with water from the city of Düsseldorf supply. The concentration during evaporation was approximately twofold. Without any corrosion protection treatment of the circulatory water, a corrosion rate of 0.18 mm/year, measured electro-chemically, occurred in the system.

With the addition of corrosion inhibitor in accordance with the invention at a rate of 50 gm/m$^3$ calculated on the circulatory water, a corrosion rate of 0.022mm/year occurred. This value is to be considered as outstanding.

The corrosion inhibitor in accordance with the invention, used in this Example, had the following composition.

20% Cyclohexanehexacarboxylic acid
16% Zinc chloride
5% A dispersion means (low-molecular weight copolymerizate of acrylic acid-methacrylic acid sodium salt)
5% A dispersion means with a base of an ethylene oxide/propylene oxide block polymer with a molecular weight of 2000 and an EO:PO ratio of 20:80.
0.5% Benzimidazole The preceding specific embodiments are illustrative of the practice of the invention. It is to be understood, however, that other expedients known to those skilled in the art or disclosed herein may be employed without departing from the spirit of the invention or the scope of the appended claims.

We claim:

1. A method for inhibiting corrosion of non-noble metals in contact with circulating water comprising the steps of adding to circulating water in contact with non-noble metals from 0.5 to 50 gm/m$^3$ of at least one cyclohexanehexacarboxylic acid and adjusting said water to a pH of from 6 to 9.

2. The method of claim 1 wherein said cyclohexanehexacarboxylic acid is added to said circulating water in an amount of from 1 to 20 gm/m$^3$.

3. The method of claim 1 wherein a corrosion inhibitor for non-ferrous metals is also added to said circulating water.

4. The method of claim 3 wherein said corrosion inhibitor for non-ferrous metals is benzimidazole.

5. The method of claim 1 wherein a biocidal agent is also added to said circulating water.

6. The method of claim 5 wherein said biocidal agent is a member selected from the group consisting of glutaraldehyde, glyoxal, sodium pentachlorophenolate and an alkyloligoamide.

7. The method of claim 1 wherein a water-soluble zinc salt is also added to said circulating water.

8. The method of claim 7 wherein said water-soluble zinc salt is added to said circulating water in such amounts as to supply from 0.5 to 10 gm/m$^3$ of $Zn^{++}$ ions.

9. The method of claim 7 wherein said water-soluble zinc salt is added to said circulating water in such amounts as to supply from 1 to 4 gm/m$^3$ of $Zn^{++}$ ions.

10. The method of claim 1 wherein a concretion preventative and dispersion agent is also added to said circulating water.

11. The method of claim 10 wherein said concretion preventative and dispersion agent is a member selected from the group consisting of an alkali metal polyacrylate having an average molecular weight of between 500 and 4000, an alkali metal salt of a copolymerizate of acrylic acid and methacrylic acid having an average molecular weight of between 500 and 4000, and an ethylene oxide/propylene oxide block polymer having an average molecular weight of between 500 and 3000 and an ethylene oxide:propylene oxide ration of from 10:90 to 30:70.

12. The method of claim 10 wherein said concretion preventative and dispersion agent is added to said circulating water in an amount of from 1 to 50 gm/m$^3$.

13. The method of claim 10 wherein said concretion preventative and dispersion agent is added to said circulating water in an amount of from 3 to 10 gm/m$^3$.

14. A corrosion inhibitory composition for use in water-conveying systems in contact with non-noble metals consisting essentially of from 10% to 90% by weight of cyclohexanehexacarboxylic acid, from 10% to 50% by weight of a water-soluble zinc salt, from 0 to 25% of a concretion prevention and dispersion agent, from 0 to 5% by weight of benzimidazole and from 0 to 2% by weight of a biocidal agent.

* * * * *